United States Patent [19]

Clark et al.

[11] 4,236,146

[45] Nov. 25, 1980

[54] SWITCHLESS CIRCUIT MALFUNCTION SENSOR

[75] Inventors: Scott A. Clark; William E. Ulmer, both of Cedar Rapids, Iowa

[73] Assignee: S. A. Clark & Associates, Marion, Iowa

[21] Appl. No.: 28,370

[22] Filed: Apr. 9, 1979

[51] Int. Cl.[3] ..... G08B 21/00

[52] U.S. Cl. ..... 340/517; 340/651; 340/652

[58] Field of Search ..... 340/517, 521, 522, 568, 340/652, 651, 508, 511, 650

[56] References Cited

U.S. PATENT DOCUMENTS 3,699,569 10/1972 Lee ..... 340/508

*Primary Examiner*—John W. Caldwell, Sr.
*Assistant Examiner*—Daniel Myer
*Attorney, Agent, or Firm*—Hill, Van Santen, Steadman, Chiara & Simpson

[57] ABSTRACT

A switchless circuit malfunction sensor utilizes only two leads, connecting open circuit sensors in parallel across the leads and closed circuit sensors in series in line with the leads. A continuity module at one end of the sensor line permits the wiring status of the monitored circuit to be constantly monitored for breaks or shorts. The continuity module can be coupled to an alarm system to activate an audio or visual signal if a circuit malfunction is sensed.

1 Claim, 2 Drawing Figures

SWITCHLESS CIRCUIT MALFUNCTION SENSOR

BACKGROUND OF THE INVENTION

1. Field of the Invention

The present invention relates to sensors and alarm systems for use in monitoring a circuit for breaks or shorts.

2. Description of the Prior Art

Alarm systems utilizing two separate pairs of sensor lines for monitoring a circuit for breaks or shorts are known in the art. Such systems use one pair of sensor lines having a series of normally closed switches disposed in line and a second pair of sensor lines having a number of normally open switches disposed in parallel across the line.

The normally closed series of switches are used to monitor a normally closed zone of the circuit, and the normally open switches are used to monitor a normally open zone of the circuit. A test switch must be connected in parallel across the normally open switches and must be manually activated to test the circuit. Continuous monitoring is thus not possible.

SUMMARY OF THE INVENTION

The present invention allows constant and simultaneous monitoring of both a normally open zone and a normally closed zone of a circuit or combination of circuits. The invention utilizes only two sensor lines, connecting open circuit sensors in parallel and closed circuit sensors in series. A continuity module at one end of the sensor line permits the status of the monitored circuit or circuits to be constantly checked for breaks or shorts.

The continuity module may be connected to an alarm system to trigger an audio or visual signal when a circuit malfunction is sensed.

A resistor module is connected to the other ends of the sensor lines to provide a reference voltage for comparison by circuitry in the continuity module.

DESCRIPTION OF THE PREFERRED EMBODIMENTS

Figure 1:
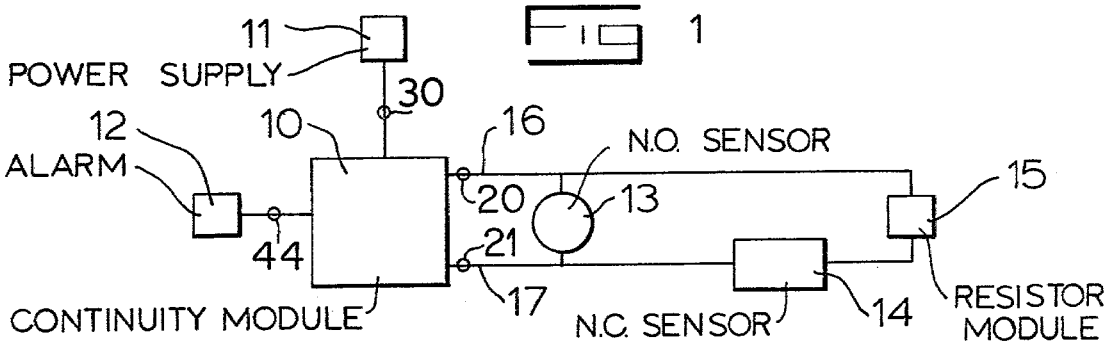
FIG. 1 is a schematic diagram of a sensor for monitoring two types of circuits.

A schematic diagram of a switchless circuit malfunction sensor is shown in FIG. 1. The sensor consists of a continuity module 10 to which are connected a power source 11, such as a battery, and an alarm 12. The alarm 12 may be visual, audio, or a combination of both.

Two sensor lines 16 and 17 are electrically connected to the continuity module 10. A normally open sensing device 13 is connected in parallel across the sensor lines 16 and 17. A normally closed sensing device 14 is connected in line with the sensor lines 16 and 17. A resistor module 15 is also connected in line with the sensor lines 16 and 17, in series with the sensing device 14.

Figure 2:
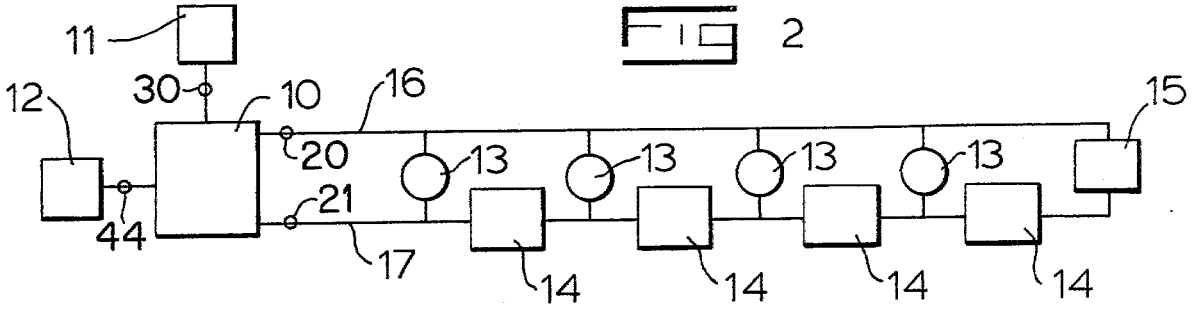
FIG. 2 is a schematic diagram of the sensor of FIG. 1 modified to accommodate a number of different circuits of both types.

An embodiment of the sensor of FIG. 1 is shown in FIG. 2 which has a number of normally open and normally closed sensors connected in parallel and series respectively to the sensor lines 16 and 17. The embodiment of FIG. 2 permits simultaneous monitoring of as many normally open and/or normally closed circuits as is desired. The power source 11, alarm 12 and resistor module 15 in FIG. 2 are identical to those in FIG. 1.

Figure 3:
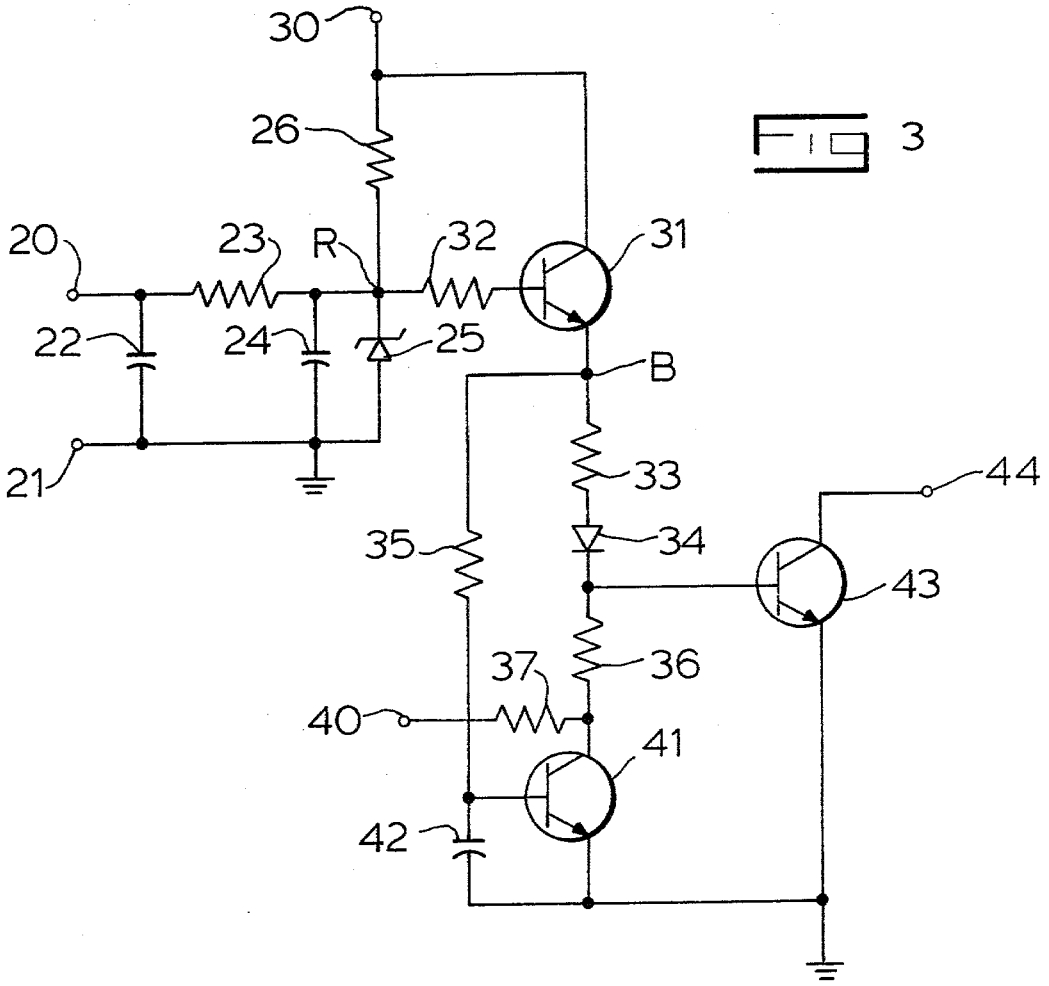
FIG. 3 is a circuit diagram of the sensing circuitry utilized in FIGS. 1 and 2.

A monitoring circuit for use in the continuity module 10 is shown in the circuit diagram of FIG. 3. A pair of input terminals 20 and 21 are connected to the sensor lines 16 and 17 respectively. A resistor 23 is connected to the terminal 20 and is capacitively connected to ground by capacitors 22 and 24 which serve the functions of filtering and transient suppression. The terminal 21 is also connected to ground. A Zener diode 25 is connected in series with resistor 23 and the series combination is connected between terminals 20 and 21 to establish a reference voltage at point R above ground.

A transistor 31 has its base connected through a resistor 32 to point R. The collector of the transistor 31 is connected to the power supply via terminal 30 and is further connected through a resistor 26 to point R. The emitter of the transistor 31 is connected to the collector of a second transistor 41 through a resistor 33, a diode 34, and another resistor 36 connected in series. The collector of the transistor 41 is also connected to a terminal 40 through a resistor 37. The base of the transistor 41 is connected to the emitter of the transistor 31 through a resistor 35. The base of the transistor 41 is capacitively coupled, and the emitter directly coupled, to ground.

The base of a third transistor 43 is connected between the diode 34 and the resistor 36. The collector of the transistor 43 is connected to a terminal 44, and the emitter of the transistor 43 is connected directly to ground.

The transistors 31,41 and 43 are shown in FIG. 3 as NPN transistors; a positive voltage will be applied to the terminals 30 and 40. It will be understood that if PNP or other types of transistors are utilized, the component values and voltages at the terminals 30 and 40 may be selected to operate the circuit without departing from the inventive concept embodied therein.

Operation of the circuit of FIG. 3 is as follows. When the sensing devices 13 and 14 are in their normal states, that is, no circuit malfunction is present, the resistor module 15 will be seen across the input terminals 20 and 21. The resistor module 15 will form a voltage divider with the resistors 23 and 26, establishing a reference voltage at point R. The transistor 31 will thus be conducting producing a positive bias voltage at a point B. This will cause the transistor 41 to be turned on forming a second voltage divider consisting of the resistors 33 and 36. When the transistor 41 is conducting, the transistor 43 will be off so that the output between the terminal 44 and ground will be high, or a logic 1. The alarm 12 has circuitry associated therewith so that the alarm is not activated as long as the logic 1 state is maintained.

A circuit malfunction will result in either one of the normally open sensing devices 13 closing, or one of the normally closed sensing devices 14 opening. In the case of one of the normally open sensing devices 13 closing, essentially zero resistance will be seen across the terminals 20 and 21 so that the bias at point B drops to essentially zero, turning the transistor 41 off. However, the low bias at point B turns on the transistor 43 so that the output of the terminal 44 is low, or a logic 0, activating the alarm 12.

In the case where one of the normally closed sensing devices 14 opens, an infinite resistance is seen across the input terminals 20 and 21 so that the voltage at point B becomes quite large and the diode 34 becomes conducting so that the transistor 43 is also conducting resulting in a low, or logic 0 voltage at the terminal 44, again activating the alarm 12.

Although the present invention has application to monitoring normally open or normally closed circuits of any type, it is particularly suitable for use with alarm circuitry presently utilized in the farm environment. Such use requires that the circuit have a maximum quiescent current draw of approximately 2 milliamperes maximum, and must have input protection circuitry to guard against voltage fluctuations. When utilized with such farm alarm devices, the following component values are appropriate. It will be understood that the values suggested are exemplary only, and operation within the inventive concept is possible utilizing different component values. It is suggested that 23 equal 56 ohms, resistors 26, 32 and 33 each equal 47 kilo-ohms, resistor 35 equals 120 kilo-ohms, resistor 36 equals 4.7 kilo-ohms, and resistor 37 equals 1 mega-ohm. It is also suggested that the coupling capacitor 42 be 0.1 microfarad. When the above component values are chosen, it is suggested that voltages of 12 volts be applied to the terminals 30 and 40. This will result in a voltage of approximately 2.1 volts at point R and of approximately 1.4 volts at point B during normal operation with a resistor module of 10 kilo-ohms. The logic 1 output voltage will thus be 12 volts DC and the logic 0 voltage will be 0 volts DC. The above component values result in a maximum quiescent current draw of 300 microamperes maximum.

Although various modifications and changes may be apparent to those skilled in the art, it is the intention of the inventors to embody within the scope of the patent warranted hereon all such modifications and changes as may reasonably and properly come within the scope of the inventor's contribution to the art.

We claim as our invention:

1. A two state output circuit for use in connection with a sensor line having a plurality of normally open and normally closed sensing devices comprising: first and second input terminals, said second input terminal connected to ground;

a first capacitor connected across said input terminals;

a first resistor connected to said first input terminal;

a second capacitor connected between said first resistor and ground;

a Zener diode connected in parallel with said second capacitor;

a first transistor having a collector connected to a power supply;

a second resistor connected between said Zener diode and said power supply;

a third resistor connected between a base of said first transistor and said Zener diode;

a fourth resistor connected to an emitter of said first transistor;

a diode connected to said fourth resistor for forward electrical conduction from said emitter of said first transistor;

a fifth resistor connected to said diode in series with said fourth resistor and said diode;

a second transistor having a collector connected to said fifth resistor and having an emitter connected to ground;

a sixth resistor connectingly disposed between said emitter of said first transistor and a base of said second transistor;

a seventh resistor connected between said collector of said second transistor and said power supply;

a third capacitor connectingly disposed between said base of said second transistor and ground; and a third transistor having a base connected between said diode and said fifth resistor, an emitter connected to ground, and a collector connected to an output terminal, whereby a voltage produced at the emitter of said first transistor when said sensing devices are in respective normally open and normally closed states maintains said second transistor in a normally on state and said third transistor in a normally off state to normally produce a first output at said output terminal, and a second voltage produced at the emitter of said first transistor when any sensing device changes to an opposite state turns said second transistor off and said third transistor on to produce a second output state at said output terminal to activate said alarm.

* * * * *